United States Patent [19]

Hage

[11] Patent Number: 4,600,296

[45] Date of Patent: Jul. 15, 1986

[54] COMPACT ELECTROGRAPHIC REPRODUCTION APPARATUS

[75] Inventor: Charles T. Hage, Rochester, N.Y.

[73] Assignee: Eastman Kodak Company, Rochester, N.Y.

[21] Appl. No.: 745,455

[22] Filed: Jun. 17, 1985

[51] Int. Cl.[4] ..... G03G 15/00

[52] U.S. Cl. ..... 355/16; 355/3 SH; 355/14 SH; 355/3 R

[58] Field of Search ..... 355/16, 3 SH, 14 SH, 355/3 R, 83, 3 TR, 3 CH, 3 DD

[56] References Cited

U.S. PATENT DOCUMENTS

| | | | |
|---|---|---|---|
| Re. 29,323 | 7/1977 | Kawakubo et al. | 355/3 R |
| 2,357,809 | 9/1944 | Carlson | 355/3 R |
| 3,058,405 | 10/1962 | Limberger | 95/1.7 |
| 3,152,528 | 10/1964 | Pendry | 355/3 R |
| 3,168,022 | 2/1965 | Limberger | 95/1.7 |
| 3,775,009 | 11/1973 | Collins | 355/83 |
| 3,909,613 | 9/1975 | Critchlon | 355/3 DD X |
| 4,087,170 | 5/1978 | Sawaoka et al. | 355/3 CH |
| 4,136,946 | 1/1979 | Nishimoto | 355/16 X |
| 4,167,326 | 9/1979 | Payne | 355/16 |
| 4,348,098 | 9/1982 | Koizumi | 355/3 TR |
| 4,372,669 | 2/1983 | Fantuzzo et al. | 355/3 R |
| 4,387,984 | 6/1983 | Sato | 355/16 X |
| 4,488,802 | 12/1984 | Sunaga et al. | 355/3 CH |
| 4,490,033 | 12/1984 | Gage et al. | 355/16 |
| 4,514,078 | 4/1985 | Béduchaud et al. | 355/3 TEX |
| 4,516,847 | 5/1985 | Maczuszenko et al. | 355/3 TR |

OTHER PUBLICATIONS

IBM Technical Disclosure Bulletin, vol. 23, No. 2, Jul., 1980.

*Primary Examiner*—A. C. Prescott

*Attorney, Agent, or Firm*—Lawrence P. Kessler

[57] ABSTRACT

A compact electrographic reproduction apparatus having a mechanism for sequentially transporting an information-bearing source document and a receiver member along a common path. By such transport mechanism, the size and cost of the apparatus are reduced due to the elimination of duplicative transport elements. The reproduction apparatus includes a photoconductive member movable about a closed loop path and electrographic process stations located relative to such path. The transport mechanism defines a common path for a source document and a receiver member. Such path is associated with the electrographic process stations and the photoconductive member whereby, when a source document and receiver member are sequentially transported along such path, information from the source document is reproduced on the receiver member. Further size and cost reductions are effected by utilizing one process station to accomplish a plurality of electrographic functions.

10 Claims, 10 Drawing Figures

COMPACT ELECTROGRAPHIC REPRODUCTION APPARATUS

BACKGROUND OF INVENTION

This invention relates in general to electrographic reproduction apparatus, and more particularly to compact electrographic reproduction apparatus wherein certain of the electrographic process functions are performed by the same mechanism and an information-bearing source document and a receiver member are sequentially transported along a common path.

A recent trend in the reprographic market place has been to provide compact, relatively inexpensive machines suitable for personal or small business use. Smaller and less expensive electrographic reproduction apparatus have been designed to serve this market. Typically, such apparatus have achieved their smaller size and reduced cost through both downsizing of components and combining functions for various electrographic process mechanisms. For example, in U.S. Pat. No. 4,488,802 (issued Dec. 8, 1984 in the name of Sunaga et al) apparatus for developing and cleaning of a photoconductive member are combined in one station, and a single charger is used to effect both photoconductive member charging and transfer of a developed image from the photoconductive member to a receiver member. Another exemplary apparatus is shown in Low Cost, Compact Copier (IBM Technical Disclosure Bulletin, Vol. 23, No. 2, July 1980, pp. 503-4) in which the process stations for accomplishing developing and cleaning, charging and transfer, and exposure and fusing are respectively combined. As shown in these apparatus, there is a limit to the amount of size and cost reductions attainable because, at least in part, separate mechanisms must be provided for handling or transporting the source document to be reproduced (the original) and the receiver member upon which the reproduction is formed.

SUMMARY OF THE INVENTION

This invention is directed to a compact electrographic reproduction apparatus having a mechanism for sequentially transporting an information-bearing source document and a receiver member along a common path, whereby the size and cost of the reproduction apparatus are reduced by eliminating duplicative transport elements. The reproduction apparatus includes a photoconductive member movable about a closed loop path. Electrographic process stations are located relative to such path for: (1) uniformly charging the photoconductive member, (2) exposing information from a source document on the photoconductive member to form an electrostatic charge pattern corresponding to such information, (3) developing such charge pattern, (4) transferring the developed pattern to a receiver member, (5) fixing the transferred pattern to such receiver member, and (6) cleaning the photoconductive member for reuse. The transport mechanism defines a common path for a source document and a receiver member. Such path is associated with the electrographic process stations and the photoconductive member whereby, when a source document and receiver member are sequentially transported along such path, information from the source document is reproduced on the receiver member. Further size and cost reductions are effected by utilizing one process station to accomplish a plurality of electrographic functions.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
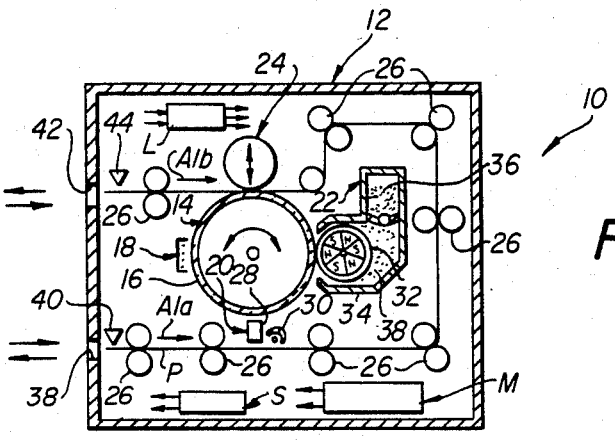
FIG. 1 is a generally schematic side elevational view, in cross-section, of a compact electrographic reproduction apparatus having a common transport path for an information-bearing source document and a receiver member according to this invention.

Referring now to the accompanying drawings, a first embodiment of a compact electrographic reproduction apparatus 10 is shown schematically in FIG. 1. The reproduction apparatus 10 comprises a housing 12 in which a cylindrical drum 14 is supported for rotation about its longitudinal axis. The drum 14, reversibly rotatable by motor M, has a surface layer 16 covered with a typical photoconductive material such as shown in U.S. Pat. No. 3,615,414 issued Oct. 26, 1971 in the name of Light. Of course, other organic or inorganic photoconductive materials are suitable for use with this invention. Electrographic process stations are located about the periphery of the drum 14 in operative relation with the photoconductive surface layer 16. Such stations include a charging station 18, an exposure station 20, a development station 22, and a transfer/fusing station 24. Further, a common path P for an information-bearing source document (an original) and a receiver member is defined in the housing 12, such as for example by wire form guides (not shown). Nip roller pairs 26, located about the path P, are driven (by motor M for example) to transport a source document or receiver member along such path in operative relation to the drum 14 and the electrographic process stations.

The interactive operation of the process stations and the motor M for making a reproduction of information from the source document on the receiver member is controlled by a logic unit L. The unit L includes a microprocessor for example which receives operational input and timing signals in any well known manner. Based on such signals and a program for the microprocessor, the unit L produces signals to control the timing of operation of the process stations for carrying out the reproduction process. The production of a program for commercially available microprocessors, such as the INTEL model 8080 or 8085 microprocessor (which along with others are suitable for use with this invention), is a conventional skill well understood in the art. The particular details of any such program would, of course, depend on the architecture of the designated microprocessor.

The electrographic process stations function in the following manner. The charging station 18 includes a corona charger coupled to an electrical potential source S for applying a uniform electrostatic charge to the photoconductive surface layer 16. The exposure station 20 includes, for example, a fiber optic lens 28 and an exposure lamp 30. The lamp 30 illuminates an information-bearing source document transported along path P. With the drum 14 and source document moving in synchronism, a reflected light image of information of the source document is directed by the lens onto the photoconductive surface layer 16 in a line-by-line fashion. Such image alters the uniform charge on the layer to form an electrostatic charge pattern corresponding image-wise to the source document information.

The development station 22 includes a magnetic brush developer 32 rotatably supported in a housing 34. The housing 34 includes a reservoir 36 for developer material. The developer material is made up of ferrite carrier particles to which pigmented marking particles (toner) adhere through triboelectric attraction. Alternatively, the material is pigmented particles having a magnetic component, generally referred to as single component toner. Such material is metered from the reservoir 36 into a sump 38 where it is attracted to the rotating magnetic brush developer 32 and brought into contact with the photoconductive surface layer 16. The charge pattern on the layer 16 overcomes the attraction of the magnetic brush for the toner, whereby the toner adheres to the layer to develop such pattern. The magnetic brush developer 32 is alternatively used to clean the photoconductive surface layer 16 of residual toner by attracting such toner from the layer to the brush for deposit in the sump 38. The transfer/fusing station 24 includes a heated roller which is coupled to the potential source S to provide an electrical bias on the roller. The roller is selectively urged into engagement with the drum 16 so that by the combination of the electrical bias, heat, and pressure, the toner developed image is transferred from the photoconductive surface layer 16 to a receiver member and substantially simultaneously fixed to the receiver member.

The operation of the compact electrographic reproduction apparatus 10 is as follows. An information-bearing source document is inserted by an operator through an access port 38 in the housing 12 into the path P. A sensor 40 adjacent to the port 38 detects the lead edge of an inserted source document and produces a signal which is sent to the logic unit L to initiate control of the reproduction process. Upon receipt of such signal, the unit L turns on motor M to activate rotation of nip roller pairs 26 in a direction to transport the source document along path P in the direction designated by arrow $A_{1a}$. The motor also initiates rotation of the drum 14 in a counterclockwise direction. The charger station 18 is simultaneously activated to uniformly charge the photoconductive surface layer 16, and the lamp 30 is turned on. As the source document is transported past the lens 28, it is illuminated by the lamp 30. A reflected light image of the information of such document is collected by the lens to expose the photoconductive surface layer 16 and form the charge pattern corresponding to such information.

The source document is transported along the path P from the exposure station 20 to an access port 42 in the housing 12 where it is returned to the operator. Substantially simultaneously the drum 14 rotates to move the image-wise charge pattern past the development station 22 where the magnetic brush 32 applies toner to the charge pattern for development thereof. The drum 14 continues rotating in the counterclockwise direction until a time when the trail edge of the developed charge pattern moves beyond the point where the roller of the transfer/fusing station 24 would contact the photoconductive surface layer 16 (during this portion of the process such roller is located at a position remote from the path P). At such time, the logic unit L turns motor M off. The operator then inserts a receiver member, such as a cut sheet of plain bond paper for example, through the access port 42 into the path P. A sensor 44, adjacent to the port 42, detects the lead edge of the receiver member and produces a signal which is sent to the logic unit L. Upon receipt of such signal, the unit L then turns the motor M on to rotate the nip roller pairs 26 in a direction to transport the receiver member along path P in the direction designated by arrow $A_{1b}$. The motor also initiates rotation of the drum in a clockwise direction. Simultaneously, the transfer/fusing station 24 is activated by moving the roller thereof from its remote position into rolling pressure contact with the drum 14.

As the receiver member is transported through the nip between the drum 14 and the roller of the transfer/-fusing station 24, the electrical bias applied to the roller attracts the toner from the developed charge pattern to the receiver member, and the pressure and/or heat fixes the toner to such member to form the reproduction. The receiver member is thereafter transported about the path P to the access port 38 where it is returned to the operator. Substantially simultaneously, the magnetic brush developer 32 is activated to clean residual (non-transferred) toner from the surface layer 16 of the rotating drum 14. When the charge pattern bearing area of the surface layer moves completely past the magnetic brush developer, the reproduction operation is completed and the motor M is again turned off. The apparatus 10 is then in a condition where it is ready to make a reproduction of a subsequently inserted information-bearing source document.

The further embodiments of the compact electrographic reproduction apparatus according to this invention, shown in FIGS. 2 through 10, include different arrangements or types of electrographic process stations. Accordingly, such embodiments will be hereinafter generally described in terms of their respective operation with only the differences in arrangement and/or types of stations being explained in detail. Further, for sake of simplicity, stations which function in a like manner, and other like elements, are designated by like identifiers with appropriate subscripts.

Figure 2:
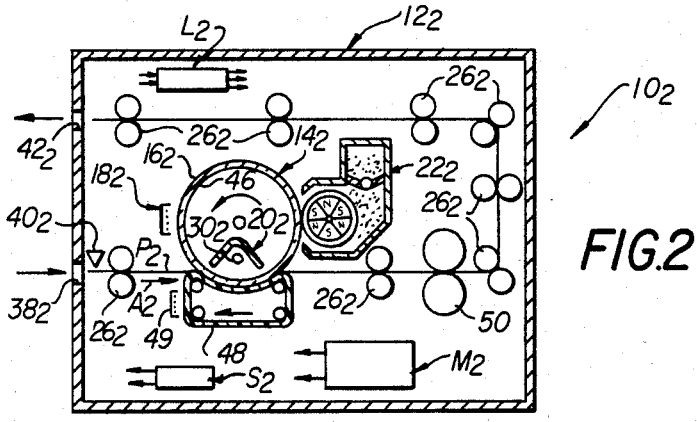
FIGS. 2 through 10 are generally schematic side elevational views, in cross-section, of further embodiments of a compact electrographic reproduction apparatus respectively having a common transport path for an information-bearing source document and a receiver member according to this invention.

In the embodiment of FIG. 2, the compact electrographic reproduction apparatus $10_2$ has a common transport path $P_2$ about which a information-bearing source document and receiver member are transported sequentially in the same direction designated by the arrow $A_2$. The source document and receiver member are inserted through access port $38_2$ and returned to the operator through access port $42_2$. The motor $M_2$ rotates nip roller pairs $26_2$ for effecting source document and receiver member transport in such one direction, and rotates drum $14_2$ in a counterclockwise direction. The photoconductive surface layer $16_2$ is transparent to actinic radiation in one direction and is supported on a transparent cylinder 46. Exposure of the layer $16_2$ to form the image-wise charge pattern is accomplished in a reflex manner. (see U.S. Pat. No. 4,387,984, issued Jun. 14, 1983 in the name of Sato). That is, the transported source document is brought into juxtaposition with the drum $14_2$ and is illuminated by a lamp $30_2$ located within the drum. The light is transmitted through the cylinder 46 and layer $16_2$ to reflect off the source document and alter the uniform charge on the layer to form the charge pattern corresponding image-wise to the information. By this arrangement, the need for a lens is eliminated.

The source document, while in juxtaposition with the drum, is held in intimate contact therewith by a traveling belt 48. The belt 48 may be formed of dielectric or conductive material so that an electrostatic charge selectively applied to the belt by corona 49 effects transfer of a toner developed charge pattern from the surface to a receiver member subsequently transported between the belt and the drum $14_2$. A fuser assembly 50, along the path $P_2$ downstream of the belt 48, fixes the transferred pattern to the receiver member by heat and/or pressure. In the operation of the apparatus $10_2$, the drum $14_2$ revolves twice about its longitudinal axis. During the first revolution, initiated by insertion of the source document, the charging, exposure and development functions are carried out. On the second revolution, initiated by insertion of the receiver, transfer and cleaning are effected.

Figure 3:
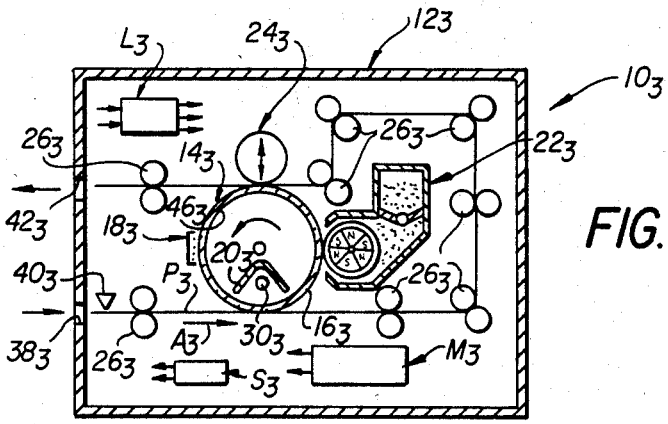

The embodiment of the compact electrographic reproduction apparatus $10_3$ of FIG. 3 is similar to that of FIG. 2 but has a combined transfer/fuser station $24_3$ similar to station 24 of the embodiment of FIG. 1. The roller of station $24_3$ is located remote from the path $P_3$ when a source document transported along such path passes in the vicinity thereof. Subsequently, such roller is brought in rolling contact with the drum $14_3$ to transfer and fix a toner developed charge pattern from the surface layer $16_3$ to a receiver member transported along path $P_3$ in the above described manner.

Figure 4:
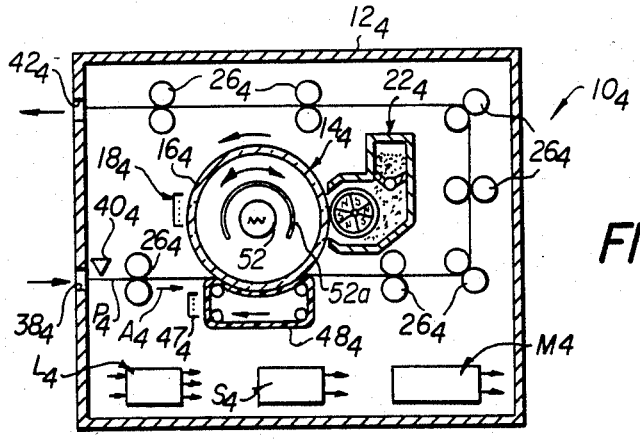

In FIG. 4, the embodiment of the compact electrographic reproduction apparatus $10_4$ is similar in construction and operation to apparatus $10_2$ of FIG. 2. However, apparatus $10_4$ includes an internal multi-functional lamp 52. The radiant energy band for the lamp 52 enables the lamp, by appropriate positioning of a movable shutter 53, to selectively serve as an exposure source for illuminating an information-bearing source document, a heat source for fixing a transferred, toner developed, charge pattern to a receiver member, and an erase light source for reducing the charge holding toner to the surface layer $16_4$ to facilitate transfer and cleaning of the toner from such layer.

Figure 5:
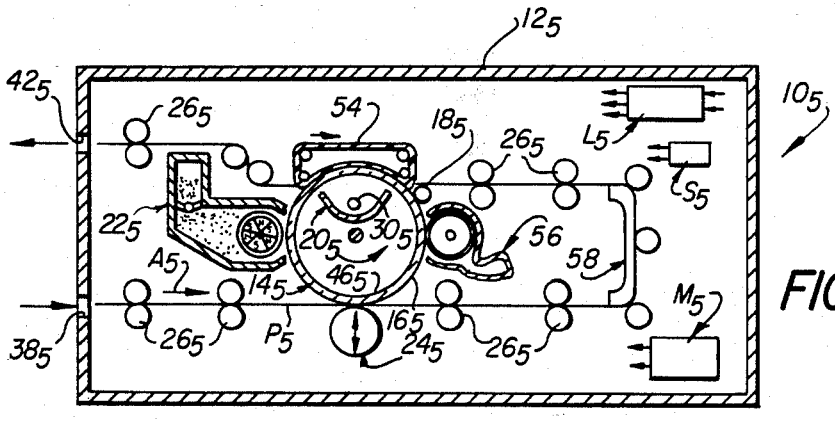

The embodiment of the compact electrographic reproduction apparatus $10_5$ of FIG. 5 includes an electrically biased roller $18_5$, coupled to potential source $S_5$ and in rolling contact with the drum $14_5$, for applying the uniform charge to the photoconductive surface layer $16_5$. A traveling belt 54 has a run in intimate contact with the drum $14_5$ to hold a source document in juxtaposition with the drum during illumination by the reflex exposure station $20_5$. While belt 54 is similar in construction to the transfer effecting belt 48 of apparatus $10_2$, the transfer function is accomplished instead by an electrically biased roller $24_5$ coupled to potential source $S_5$ and selectively moved into nip relation with the drum $14_5$. Additionally, the development and cleaning functions are respectively performed separately by a magnetic brush development station $22_5$ (similar to station 22 of apparatus 10) and a rotating fiber brush cleaning station 56.

With the arrangement of FIG. 5, the entire electrographic cycle is accomplished during one revolution of the drum $14_5$, rather than the required two revolutions of the previously described embodiments. That is, the information-bearing source document and receiver member are inserted seriatim into the path $P_5$ through access port $38_5$, and are transported simultaneously under control of the logic unit $L_5$ at a preselected distance apart about the path. Such distance ensures that an image-wise charge pattern (corresponding to information from the source document) formed on the surface layer $16_5$ of drum $14_5$ at exposure station $20_5$, is developed and arrives at the transfer station $24_5$ in register with the arrival of the transported receiver member at the transfer station. After transfer of the toner developed charge pattern to the receiver member, the receiver member is transported into contact with a heated fuser assembly 58 to fix the transferred pattern to such member, and residual toner is cleaned from the drum $14_5$ by cleaning station 56. Thereafter the apparatus $10_5$ is immediately ready to make another reproduction.

The embodiments shown in FIGS. 6 through 10 utilize an endless web in place of the drum of the embodiments of FIGS. 1 through 5. The web has a photoconductive surface layer, similar to that described above for the drum, fixed to a flexible transparent support. In the compact electrographic reproduction apparatus $10_6$ of FIG. 6, the web 60 is entrained about rollers 62 and 64. The roller 62 is driven about its longitudinal axis by motor $M_6$ to move the web 60 about its endless path in the direction of arrow $B_6$ through the electrographic process stations. The roller 64 is a transparent cylinder within which the exposure station $20_6$ is located to provide for reflex exposure as described above with reference to apparatus $10_2$. The path $P_6$ directs a transported source document, and subsequently a receiver member, into intimate contact with the moving web 60 between the charging station $18_6$ and a traveling belt $48_6$. The belt $48_6$ is similar to the belt 48 of apparatus $10_2$ in that it selectively holds a source document in juxtaposition with the photoconductive surface layer $16_6$ during exposure, and transfers and fixes a toner developed charge pattern to a receiver member. As is apparent, the web 60 makes two revolutions about its endless path during a complete electrographic process cycle. That is, on the first revolution, charging, exposure and development are carried out; and on the second revolution, transfer and cleaning are accomplished.

Figure 6:
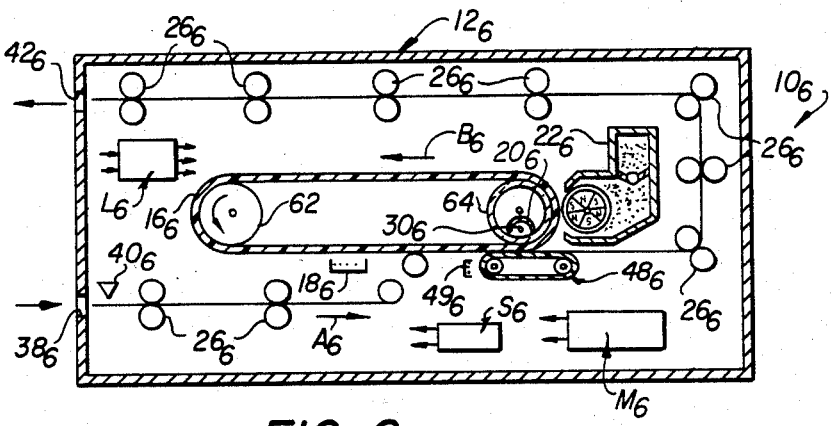
Figure 7:
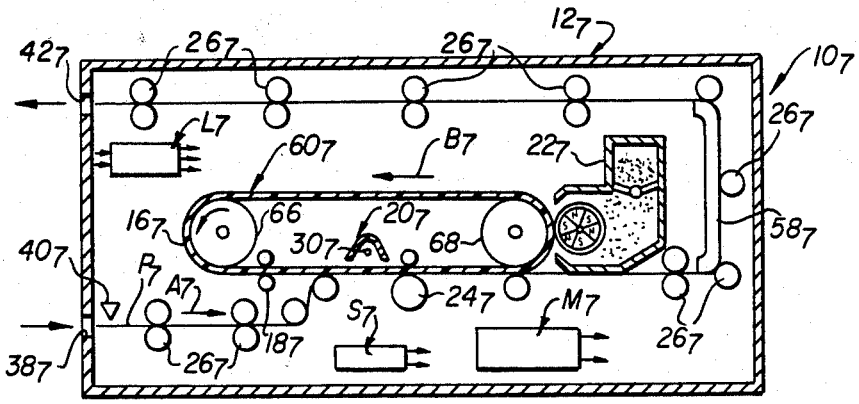

In the embodiment of the compact electrographic reproduction apparatus $10_7$ of FIG. 7, the web $60_7$ is entrained about rollers 66, 68 of like construction (similar to roller 62 of FIG. 6). Reflex exposure is provided by the exposure station $20_7$ located in the interior of the web between the rollers 66, 68. The charging station $18_7$ and transfer station $24_7$ are electrically biased rollers respectively coupled to potential source $S_7$ and in rolling contact with the web (similar to rollers $18_5$ and $24_5$ respectively of apparatus $10_5$ shown in FIG. 5). The fuser assembly $58_7$ is also similar to the fuser assembly $58_5$ of apparatus $10_5$. The operation of the electrographic process cycle for apparatus $10_7$ is similar to that described for apparatus $10_6$.

Figure 8:
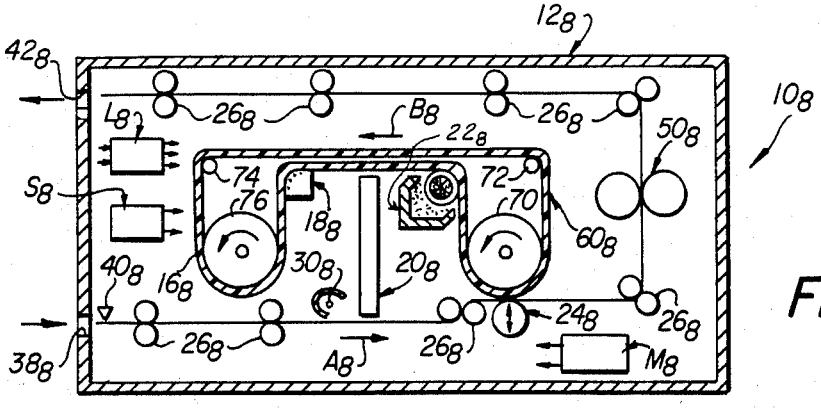

The embodiment of the compact electrographic reproduction apparatus $10_8$ shown in FIG. 8 employs a web $60_8$ entrained about rollers 70, 72, 74, 76, and charger station $18_8$ and development station $22_8$ to define a generally inverted U-shaped endless path. By this arrangement, the information-bearing source document and the receiver member are transportable simultaneously about the path $P_8$ seriatim, under control of the logic until $L_8$, at a preselected distance apart. The electrically biased transfer roller $24_8$ (similar to roller 24 of apparatus 10) is selectively movable to urge a receiver member into contact with the web $60_8$ and effect transfer of a toner developed charge pattern from the web to the receiver member.

Figure 9:
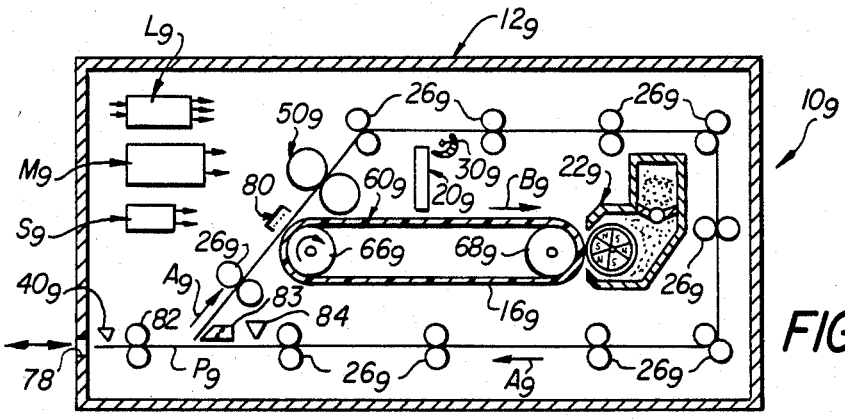

The compact electrographic reproduction apparatus $10_9$ of the embodiment shown in FIG. 9 has a path $P_9$ which communicates with a single access port 78 in the housing $12_9$. When the lead edge of an information-bearing source document is inserted into the path through port 78, such lead edge is detected by sensor $40_9$. The sensor sends a signal to the logic unit $L_9$ to initiate control of the reproduction process. Upon receipt of such signal, unit $L_9$ turns on motor $M_9$ to move the web $60_9$ in the direction of arrows $B_9$ past charging station 80 to receive a uniform electrostatic charge. Thereafter a deflector 83 is positioned relative to path $P_9$ and nip roller pairs 82 and $26_9$ are rotated to transport the information-bearing source document into the upper branch of such path. Then, with the uniform charge on the photoconductive surface layer $16_9$ of the web $60_9$, when the source document passes exposure station $20_9$, the charge is altered to form an image-wise charge pattern corresponding to information of such document in a similar manner to that described for exposure station 20 of the embodiment of apparatus 10. As the source document continues around the path $P_9$, it is detected by a sensor 84, similar to sensor $40_9$. The sensor 84 sends a signal to the logic unit $L_9$ which causes the unit to reverse the drive to nip rollers 82 and move deflector to a remote location relative to the path $P_9$ to enable the source document to be returned to the operator through access port 78.

While the source document is returning to the operator, the charge pattern is developed by development station $22_9$ and brought to a location adjacent to the charging station 80 where the movement of the web is momentarily interrupted. The operator then inserts the receiver member into the path $P_9$ through the access port 78 where its lead edge is detected by sensor $40_9$ and a signal is sent to the logic unit $L_9$. Upon receipt of such signal, the unit repositions the deflector 83 and restarts the drive for the nip rollers 82 and $26_9$ to transport the receiver member into the upper branch of path $P_9$. As the lead edge of the receiver member approaches the charging station 80, the logic unit $L_9$ restarts movement of the web $60_9$. The timing of transport of the receiver member and movement of the web are particularly interrelated so that the receiver member and the toner developed charge pattern pass the charging station 80 in register. The charging station 80 then effects transfer of the toner developed charge pattern to the receiver member, and the fusing assembly $50_9$ fixes the transferred pattern to such member. Thereafter, the reproduction bearing receiver member continues about the path $P_9$ and is detected by sensor 84 which sends a signal to the logic unit $L_9$. Upon receipt of such signal, the unit repositions the deflector 83 and reverses the drive for nip rollers 82 to return the receiver member to the operator. Simultaneously, the web $60_9$ is moved past the developement station $22_9$ where residual toner is cleaned in a similar manner to that described for development station 20 of the embodiment of apparatus 10. The apparatus $10_9$ is then ready to make another reproduction.

Figure 10:
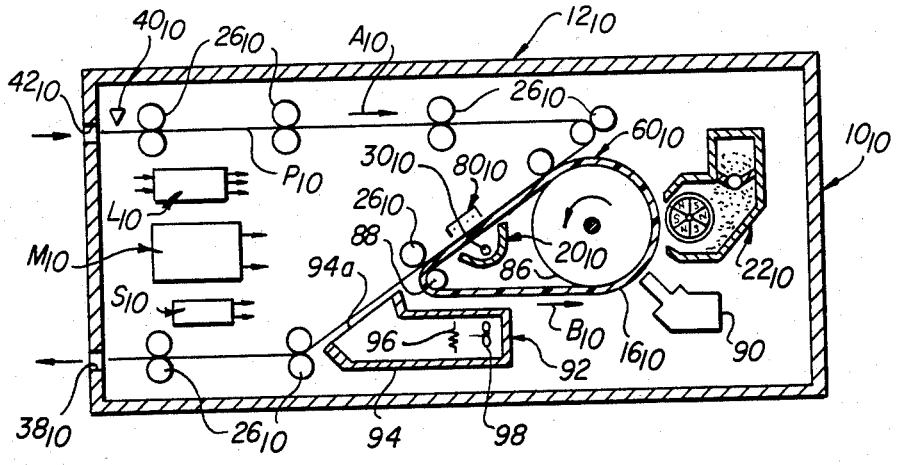

In the embodiment of the compact electrographic reproduction apparatus $10_{10}$ of FIG. 10, the web $60_{10}$ is entrained about roller 86 and roller 88, of a substantially larger diameter, to assume a substantially triangular path. The common path $P_{10}$ for the source document and the receiver member has a portion coincident with one leg of such triangular path. A charging station $80_{10}$ (structurally and functionally similar to charging station 80 of apparatus $10_9$) and an exposure station $20_{10}$ (structurally and functionally similar to exposure station $20_7$ of apparatus $10_7$) are located on opposite sides of the coincident path portion. Further, apparatus $10_{10}$ has a second exposure station 90 located adjacent to the web $60_{10}$ upstream of the development station $22_{10}$. Exposure station 90 includes, for example, a bank of light emitting diodes or electrostatic print heads directed at the web. The individual elements of the exposure station 90 are respectively controlled by the logic unit $L_{10}$. By such control, the charge on the photoconductive surface layer $16_{10}$ of the web $60_{10}$ can be altered to any desired extent. For example, areas of the surface layer charge can be completely erased, or altered to add new or additional information to source document information for reproduction. Alternatively, the exposure station 90 may be controlled to serve as the sole source of information to be reproduced thereby eliminating the need for a source document.

After the charge pattern is formed on the photoconductive surface layer $16_{10}$ by exposure station $20_{10}$ and/or exposure station 90, the pattern is developed and transferred to a receiver member in a similar manner to that described for apparatus $10_9$. Fixing of a transferred toner developed charge pattern on a receiver member is accomplished by a fuser assembly 92. The fuser assembly 92 includes a housing 94 having a heater element 96 and a fan 98 for blowing air over the heating element. The housing has an opening 94*a* adjacent to the path $P_{10}$ downstream of the area where a developed charge pattern is transferred to a receiver member. Heated air exiting through the opening 94*a* impinges on the receiver member and fixes the toner developed charge pattern to the receiver member. The air flow effected by the fan 98 is selected to be at a level such that the toner of the developed charge pattern is not disturbed prior to completion of fixing of such toner to the receiver member.

The invention has been described in detail with particular reference to preferred embodiments thereof, but it will be understood that variations and modifications can be effected within the spirit and scope of the invention.

I claim:

1. A compact electrographic apparatus, said apparatus comprising:

a photoconductive member movable about a closed loop path;

electrographic process means, located relative to such path, for (1) uniformly charging said photoconductive member, (2) exposing information from a source document onto the photoconductive member to form an electrostatic charge pattern corresponding to such information, (3) developing such charge pattern, (4) transferring the developed pattern to a receiver member, (5) fixing the transferred pattern to such receiver member, and (6) cleaning the photoconductive member for reuse, means for sequentially transporting a source document and a receiver member selectively along a common path associated with said electrographic process means and said photoconductive member; and means for controlling said electrographic process means to reproduce information from a source document on a receiver member.

2. The invention of claim 1 wherein electrographic process means includes means for simultaneously transferring and fixing a developed charge pattern from said photoconductive member to a receiver member.

3. The invention of claim 1 wherein said photoconductive member travels a plurality of times about its closed loop path; and wherein said electrographic process means includes means for developing such charge pattern during one travel cycle and cleaning said photoconductive member for reuse during a second travel cycle.

4. The invention of claim 1 wherein said photoconductive member travels a plurality of times about its closed loop path; and wherein said electrographic process means includes means for uniformly charging said photoconductive member during one travel cycle and transferring such developed pattern to a receiver member during a second travel cycle.

5. The invention of claim 1 wherein said photoconductive member is substantially transparent to actinic exposure radiation in one direction; and wherein said electrographic process means includes an exposure radiation source located within such photoconductive closed loop path for exposing information from such source document onto said photoconductive member by reflex exposure.

6. The invention of claim 1 wherein said transport means includes a first access port at one end of such common path and a second access port at the opposite end of such common path, and wherein a source document and a receiver member enter such common path at said first access port and exit such path at said second access port.

7. The invention of claim 1 wherein said photoconductive member travels about its closed loop path in one direction during charging, exposing, and developing functions of said electrographic process means, and in the opposite direction during transfer, fixing, and cleaning functions of said electrographic process means.

8. The invention of claim 7 wherein said transport means includes a first access port at one end of such common path and a second access port at the opposite end of such common path; and wherein a source document enters such common path at said first access port and exits such path at said second access port while said photoconductive member travels about its closed loop path in said one direction, and a receiver member enters such common path at said second access port and exits such path at said first access port while said photoconductive member travels about its closed loop path in said opposite direction.

9. In an electrographic apparatus including a photoconductive member movable about a closed loop path and electrographic process means for reproducing information from a source document on a receiver member, an improved transport means for enabling said electrographic apparatus to be of a simplified and compact construction, said transport means comprising:

guide means for defining a common path for a source document and a receiver member, such common path being associated with said electrographic process means and said photoconductive member to locate a source document and receiver member respectively in operative relation therewith; and drive means, associated with said guide means, for selectively moving a source document and a receiver member along such common path.

10. The invention of claim 9 wherein said guide means includes a first access port at one end of such common path; a second access port at the opposite end of such common path; sensing means, associated with said first and second access ports, for detecting insertion of a source document or receiver member into such common path through one of said access ports; and control means, associated with said sensing means, for controlling operation of said drive means to move an inserted source document or receiver member about such common path from said one access port to the other access port.

* * * * *